219-121 SR
3/15/88 OR 4,731,517

United States Patent [19]
Cheney

[11] Patent Number: 4,731,517
[45] Date of Patent: Mar. 15, 1988

[54] POWDER ATOMIZING METHODS AND APPARATUS

[76] Inventor: Richard F. Cheney, 12 Sunset Hill Ave., Norwalk, Conn. 06851

[21] Appl. No.: 839,284

[22] Filed: Mar. 13, 1986

[51] Int. Cl.[4] ..... B23K 9/00
[52] U.S. Cl. ..... 219/121 PY; 219/121 PX; 219/121 PN; 425/7; 264/8; 264/12; 75/10.19; 75/10.34
[58] Field of Search ..... 219/121 P, 121 PX, 121 PY, 219/121 PN, 75; 264/8, 12, 14, 11, 13; 425/7, 6; 75/10.19, 10.21, 10.34, 62, 65 R

[56] References Cited

U.S. PATENT DOCUMENTS

| | | | |
|---|---|---|---|
| 3,313,608 | 1/1967 | Guyer et al. | 65/21 |
| 3,829,538 | 7/1974 | Darmara et al. | 264/8 |
| 4,069,045 | 10/1978 | Lundgren | 75/251 |
| 4,076,640 | 1/1978 | Forgensi et al. | 427/127 |
| 4,199,338 | 4/1980 | Levecque et al. | 264/12 |
| 4,221,587 | 9/1980 | Ray | 75/0.5 C |
| 4,251,599 | 4/1981 | McCormick | 428/682 |
| 4,264,641 | 7/1981 | Mahoney et al. | 75/0.5 C |
| 4,376,740 | 2/1983 | Uda et al. | 264/10 |
| 4,386,896 | 11/1983 | Ray | 425/7 |
| 4,390,368 | 6/1983 | Houck | 75/251 |
| 4,419,060 | 12/1983 | Speier et al. | 264/8 |
| 4,435,342 | 3/1984 | Wentzell | 264/8 |
| 4,435,342 | 10/1984 | Wentzell | 428/8 |
| 4,474,604 | 8/1984 | Nakamura et al. | 75/0.5 C |
| 4,490,601 | 2/1984 | Yokoyama | 219/69 R |
| 4,559,187 | 12/1985 | Haour et al. | 264/14 |
| 4,592,781 | 3/1986 | Cheney | 75/249 |

*Primary Examiner*—M. H. Paschall
*Attorney, Agent, or Firm*—Mattern, Ware, Stoltz & Fressola

[57] ABSTRACT

Atomizing techniques produce fine and uniform ceramic powders and metal powders, by melting the particulate metal or ceramic to be atomized at high temperatures in a plasma melting torch, impacting the stream of high temperature gas and drops of molten feed material against a suitable moving impact substrate to produce fine droplets, and chilling these droplets in a quench gas to produce rapid solidification, optimizing internal crystal structure. The substrate is formed as a disk or belt moved continuously to produce constantly changing impact zones, and a liquid rinsing and squeegee wiping operation or a vacuum cleaning operation is employed to clear the substrate of any accumulated residue of the impacted material. The rapidly solidified particles are recovered by filtration or separating steps from the quench gas and the rinsing liquid. A preferred impact substrate material is a thin layer or Teflon FEP laminated to a slightly thicker layer of aluminum foil.

26 Claims, 14 Drawing Figures

FIG. 7 SAMPLE 14-1-C
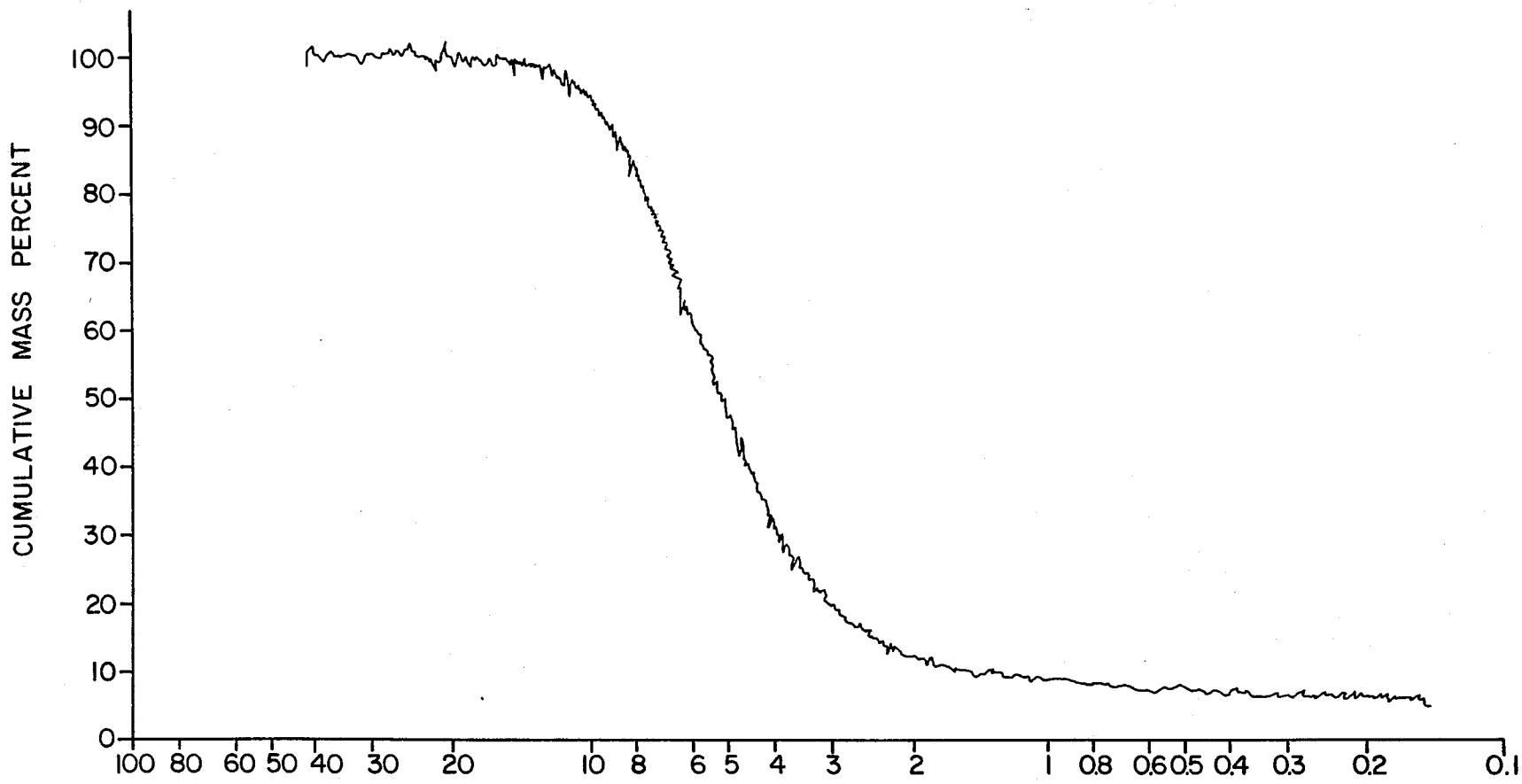
PARTICLE SIZE DISTRIBUTION OF ZIRCONIA MICROATOMIZED USING DRY TEFLON FEP FILM.

FIG. 8 SAMPLE 15-3-C
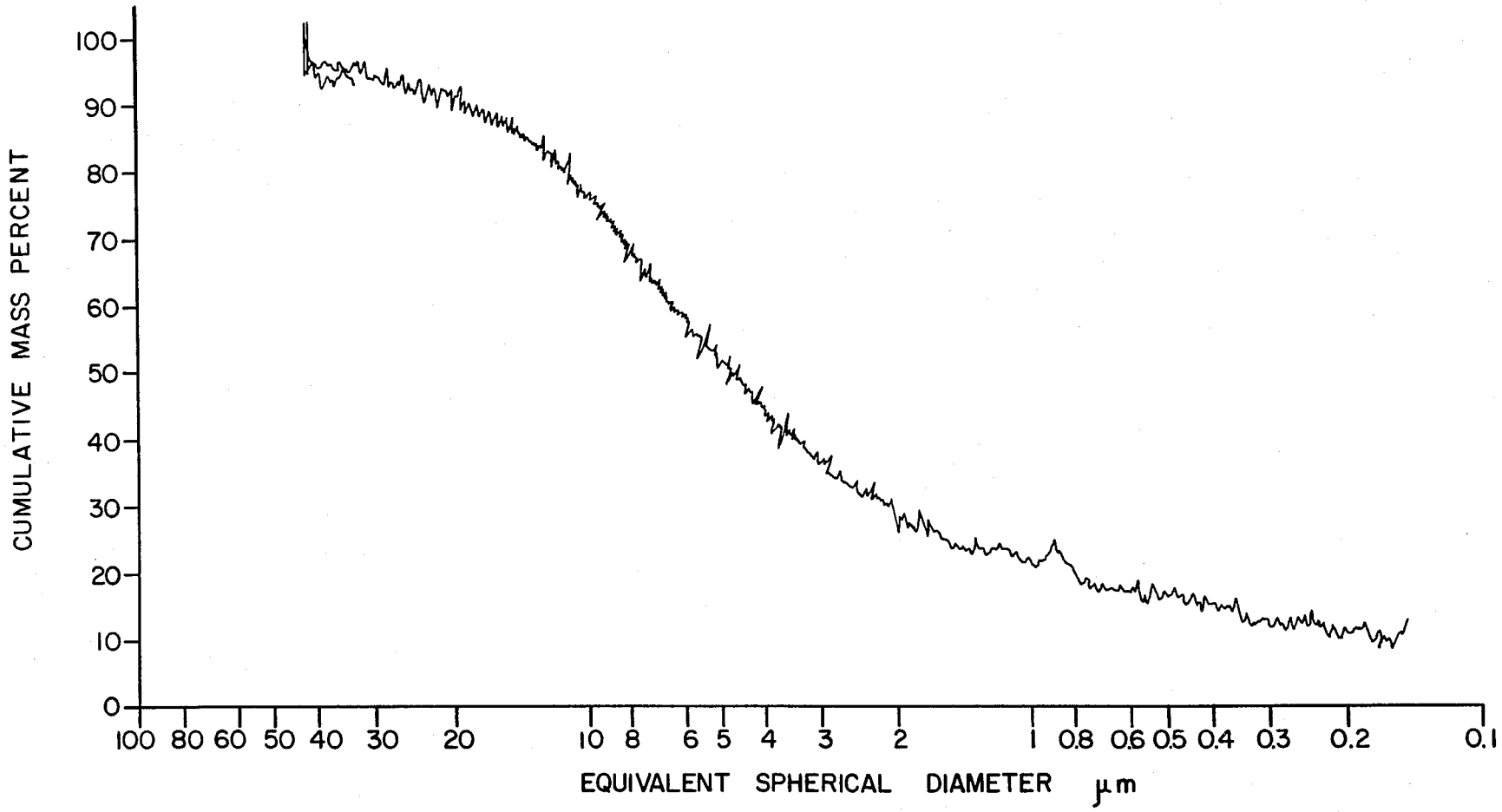
PARTICLE SIZE DISTRIBUTION OF ZIRCONIA MICROATOMIZED USING WET TEFLON FEP FILM AND A 5" GUN/SUBSTRATE DISTANCE.

FIG. 9 SAMPLE 14-2-C
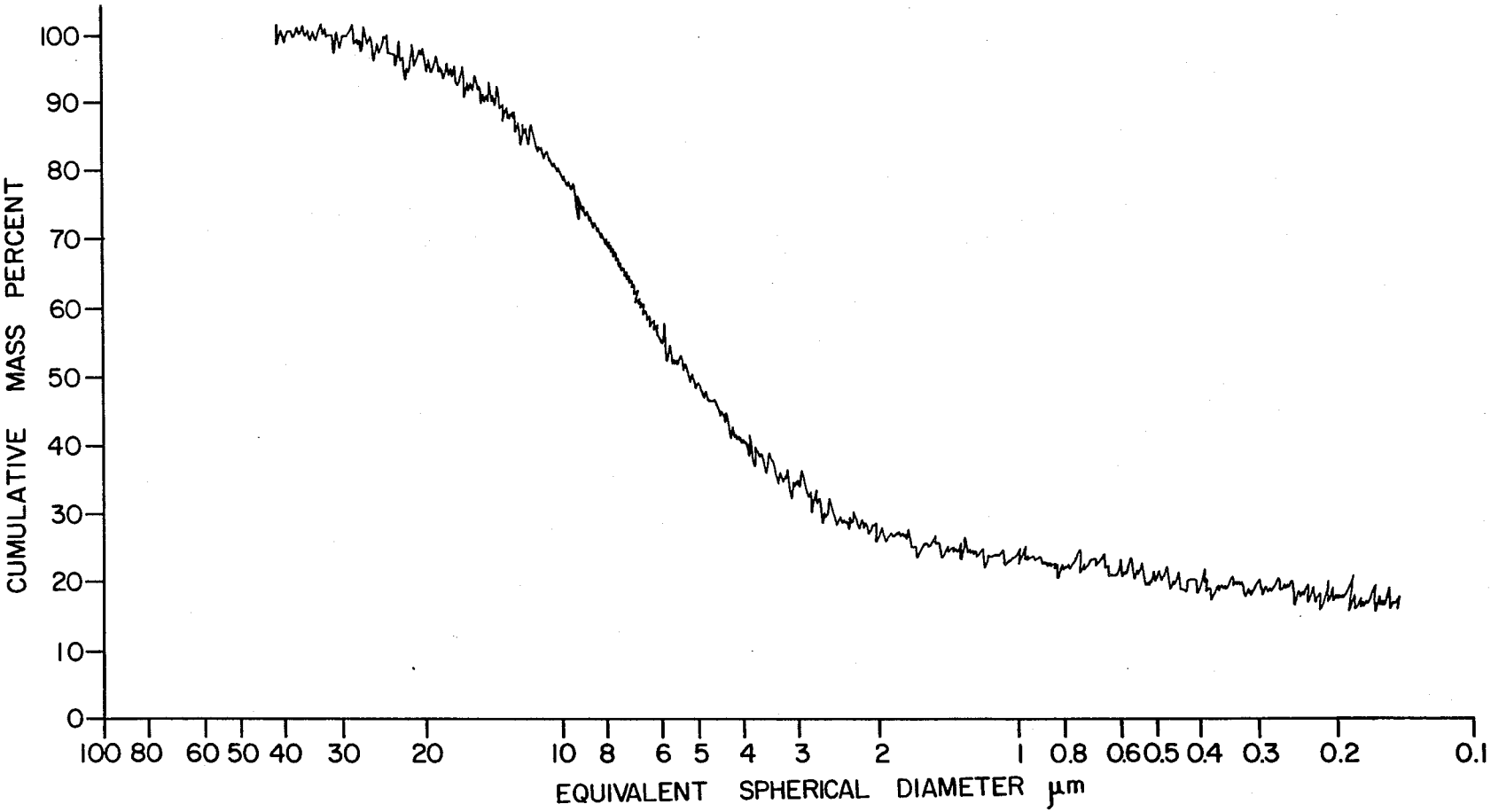
PARTICLE SIZE DISTRIBUTION OF ZIRCONIA MICROATOMIZED USING WET TEFLON FEP FILM AND A 4" GUN/SUBSTRATE DISTANCE.

FIG. 10 SAMPLE 15-2-C
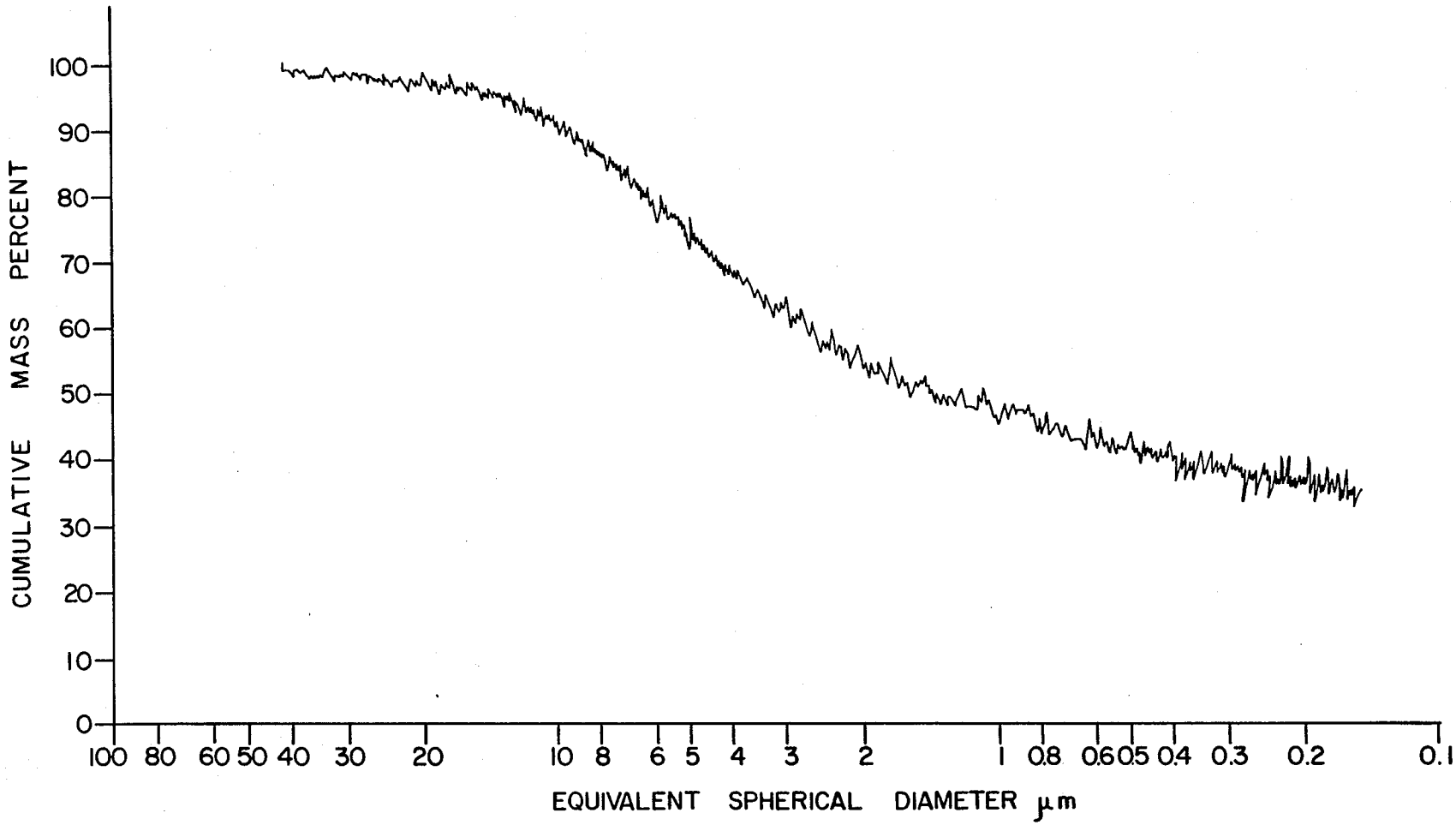
PARTICLE SIZE DISTRIBUTION OF ZIRCONIA MICROATOMIZED USING WET TEFLON FEP FILM AND A 3" GUN/SUBSTRATE DISTANCE.

FIG. 11 SAMPLE 14-3-C
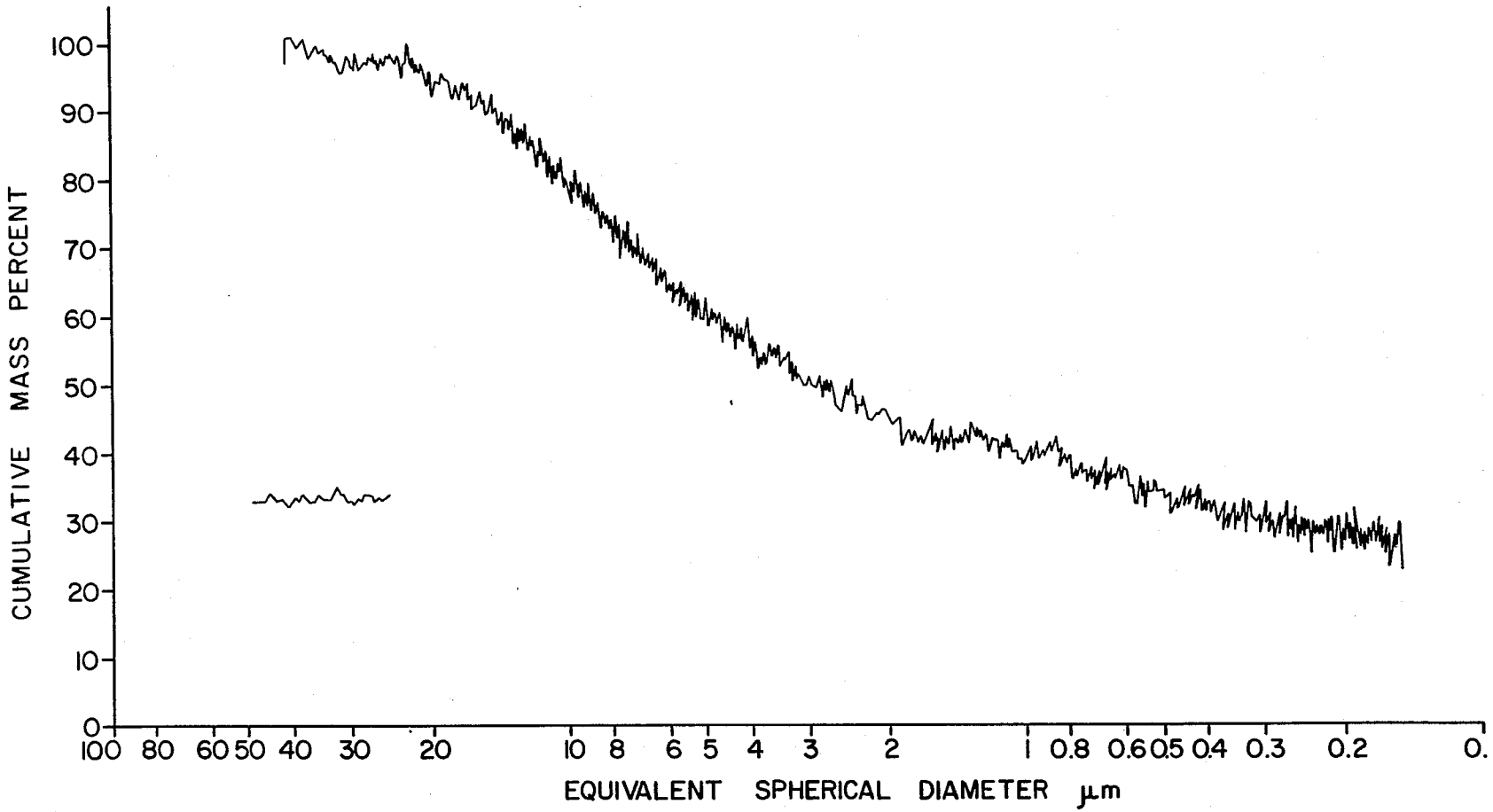
PARTICLE SIZE DISTRIBUTION OF ZIRCONIA MICROATOMIZED USING WET TEFLON FEP FILM AND A GUN/SUBSTRATE ANGLE OF 45 DEGREES.

POWDER ATOMIZING METHODS AND APPARATUS

This invention relates to atomization techniques for producing ceramic powders and metal powders with extremely fine particle size, high density and optimum crystal and grain structure.

In particular, these techniques employ methods and apparatus for melting the particulate metal or ceramic to be atomized at high temperatures in a plasma melting torch, impacting the stream of high temperature gas and drops of molten material against a suitable moving impact substrate to produce extremely fine droplets, chilling these droplets in a quench gas to produce rapid solidification, moving the substrate continuously to produce constantly changing impact zones while employing a liquid rinsing and wiping operation to clear away any accumulated residue of the impacted material, thus providing a fresh substrate impact surface for the next substrate exposure to the molten drop gas stream, and collecting the rapidly solidified droplet particles in suitable filtration or separating steps performed on the used quench gas and wiping liquid.

A preferred substrate material has been discovered to be a thin layer of Teflon FEP polytetrafluoroethylene film, laminated to a slightly thicker layer of aluminum foil adhesively bonded to a support, which may be a flexible moving belt or a rotating disk. The substrate is continuously moved past the gas and molten drop stream, with liquid rinsing and wiping being employed, just ahead of the impact stream, to clean the substrate of atomized powder residues from previous impacts. Atomized powders are produced with very fine particle diameters, high densities, and optimum internal structures. These are well adapted for flame coating, hot pressing, sintering and heat treatment at unexpectedly low temperature ranges, and they permit highly effective "alloying" of two or more different phases of fine ceramic powders or metals or combinations of metals with ceramics in the final hot pressed or sintered product.

Free-flowing powders for flame spray applications are disclosed in detail in my previous U.S. Pat. Nos. 3,909,241, 3,974,245 and 3,881,911. Desired particle size ranges less than 60 micrometers (i.e., "microns") and preferably with 80 percent of the particles having sizes less then 30 micrometers have been considered optimal for flame spraying applications. Such powders have been produced by milling, screening and cyclone separation, with undersized particles being recycled into the original slurry and spray dried to leave only the desired particle size ranges for flame spraying use.

Several prior United States patents have suggested impact methods for subdividing molten metal or metaloid streams to produce fine particle sizes, such as U.S. Pat. Nos. 4,419,060 and 4,435,342. These patents employ heated crucibles of molten metal, but the techniques of the present invention avoid the inconvenience, expense and the risk of contamination of feed stocks by delivering the gas and pulverized feed materials directly to the plasma torch with temperatures of 3000 degrees Celsius and upwards are created almost instantaneously as the torch delivers the molten drops in its output stream. The method steps and the combined apparatus subassemblies employed in the techniques of the present invention are believed to be entirely different from all prior art techniques.

Much finer particle sizes, ranging between one-tenth and twenty-five micrometers, and preferably between one and ten micrometers have been in great demand for metal powders, and between one-tenth and one micrometer for ceramic powders, for such techniques as hot pressing, low temperature sintering, pressure assisted sintering and ceramic mold processing, to improve the density of the sintered components with reduced microporosity and shortened sintering time.

The rapid solidification of the molten droplets rebounding from the impact substrate produces the desired range of fine particle sizes coupled with unexpectedly valuable characteristics in the resulting fine particles of atomized metal or ceramic. Virtually instantaneous chilling produces optimum chemical homogeneity of the solidified particles, and molecules of all different elements present are uniformly distributed in each solidified particle. Rapid chilling produces fine grain size, achieving strength and toughness in the resulting solid, enhanced resistance to chemical attack or corrosion, and in some cases, enhanced electrical properties. Quick chilling minimizes the time available for growth of ordered crystal structures freezing outward from crystallization centers to meet each other along grain boundaries, producing either a single crystal, an amorphous glass-like particle with no internal grain boundaries, or a particle with desirably fine grain size.

Accordingly, a principal object of the present invention is to combine plasma torch melting with impact atomization and rapid chilling steps to achieve highly desired very fine particle powders of metals or ceramics.

Another object of the invention is to provide such methods and apparatus producing atomized powers having a majority of their particles substantially spheroidal in shape with desirably high densities and uniform, homogeneous structure.

A further object is to provide such methods and apparatus taking advantage of rapid chilling and solidification of molten droplets to produce atomized particles comprising a single crystal or having an amorphous, glass-like composition or having very fine grain size.

Still another object of the invention is to provide such methods and apparatus for producing such atomized power particles with particles size ranges falling between one-tenth and twenty-five micrometers.

A still further object to the invention is to provide methods and apparatus for producing such atomized powers efficiently and economically.

Other objects of the invention will in part be obvious and will in part apear hereinafter.

The invention accordingly comprises the features of construction, combinations of elements, and arrangements of parts which will be exemplified in the constructions hereinafter set forth, and the scope the invention will be indicated in the claims.

For a fuller understanding of the nature and objects of the invention, reference should be had to the following detailed description taken in connection with the accompanying drawings, in which

THE DRAWINGS

FIGS. 7–11 are particle size distribution charts for representative sample power batches identified in Table 1 below.

Figure 1:
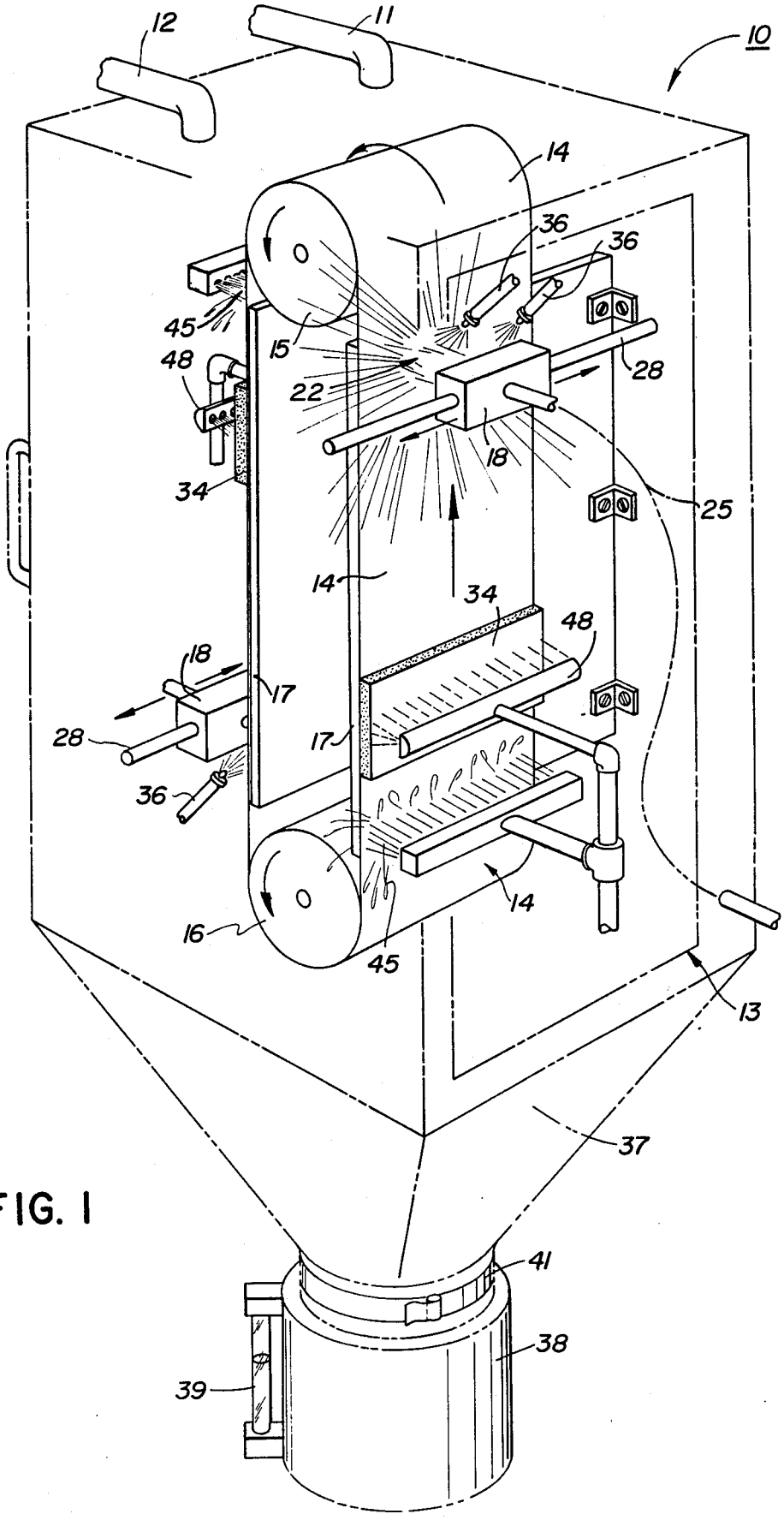
FIG. 1 is a perspective schematic view broken away to show the internal construction of the plasma melting and atomization apparatus employed in a first embodiment of the present invention.
Figure 3:
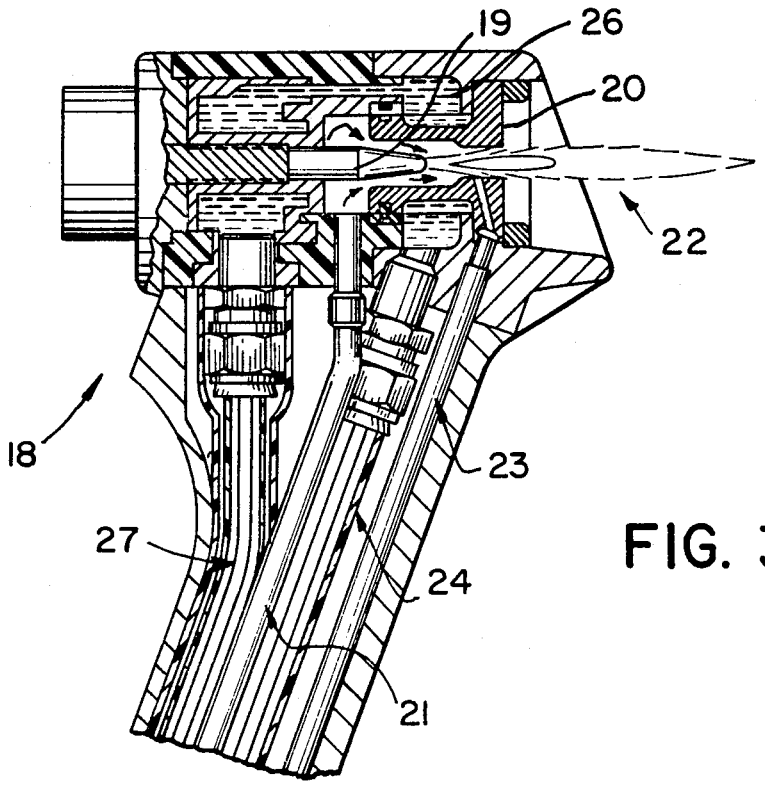
FIG. 3 is a schematic cross-sectional side elevation view of a plasma torch or plasma gun which is commercially available, of the kind used in the methods of the present invention.

A preferred embodiment of the apparatus employed in one form of the present invention is illustrated schematically in FIGS. 1 and 3, where all of the moving parts of the apparatus are shown positioned inside a double-walled, water-jacketed enclosure 10. This heat insulating dual-walled enclosure is provided with a cooling water inlet conduit 11 and outlet conduit 12. It is also provided with two hinged gasketed doors 13 on opposite side walls which may be clamped shut or swung open to provide ready access to the interior of housing 10. Each of the doors 13 is gasketed with suitable O-ring type gasket material 49 of heat resistant polymer, and each hinged door is also provided with internal cooling cavities connected by external flexible tubing 11A and 12A to the cooling water chambers inside the dual walls of housing 10.

ENDLESS BELT SUBSTRATE

Vertically arrayed between the two doors 13 is an endless belt 14 with an extremely smooth, low friction outer surface. Belt 14 passes over an upper roller 15 and forms a closed loop spanning the distance between roller 15 and a lower idler roller 16, which may be biased downward by springs or weights if desired to take up any slack in belt 14. This maintains slight tension in the belt, assuring that its sides, serving as the impact zones for the atomization step, are smooth and flat.

Directly behind each smooth, flat side run of belt 14 is positioned a support platen 17. These support platens are shown positioned between the two straight runs of belt 14 on the interior of the endless belt loop, and anchored in these positions with their end edges secured to the interior walls of the housing 10. They are preferably hollow, with their interior chambers connected to the cooling water chambers inside the dual walls of housing 10.

Shown at the upper right and lower left of the internal chamber of housing 10 in FIG. 1 are two plasma torches 18 mounted for reciprocating transverse movement parallel to the surface of the flat side runs of endless belt 14 with their output streams aimed at the exposed face of the belt. Support platens 17 serve to counteract any belt deflection which would otherwise be produced by the impact stream from each plasma torch.

The plasma torches 18 are shown schematically in the drawings, and they incorporate the features shown in FIG. 3, where a Dresser Industries' Plasmagun is shown in a cross-sectional side elevation view delineating its working parts. The plasma gun or torch 18 is formed with a high voltage internal electric arc passing between its central cathode 19 and the surrounding ring-shaped nozzle or anode 20. A continuous supply of high-pressure gas, typically helium, argon or nitrogen, is delivered through a gas inlet 21. The electric arc produced between the cathode 19 and the anode 20 is thereby swept forward through the nozzle anode as a high temperature plasma jet 22, whose temperature normally exceeds 3,000 degrees Celsius.

A stream of pulverized feed stock powder ranging in average particle size from 50 to 500 micrometers is also supplied to the plasma torch 18 through a powder feed tube 23, delivering the powder feed stock directly into the ring-shaped anode 20 where it is swept from the plasma torch in the high temperature plasma jet 22. Pulverized particles of the powder are rapidly melted and the plasma jet thus becomes a high temperature, high velocity gas jet in which drops of molten feed stock powder are entrained.

The enormous temperatures achieved in the plasma jet would soon melt the plasma torch 18 if it were not provided with a continuous supply of cooling water entering the device through a water inlet 24, to encircle the periphery of the ring-shaped anode in a cooling chamber 26 from which it travels rearwardly through a rear peripheral portion of chamber 26 encircling the cathode 19, and then exits from the torch through a water outlet 27.

A flexible supply conduit 25 inside housing 10 connects feed tube 23, cooling water conduits 24 and 27 and electrical power cables to each plasma torch 18.

As shown in FIG. 1, the plasma jet 22 issuing from each plasma torch 18 is directed toward the smooth flat vertical run of substrate belt 14. Each plasma torch 18 is mounted for reciprocating transverse movement, parallel to the flat vertical run face of belt 14, moving back and forth along a guide bar 28 and driven by such means as a reversible rack and pinion drive or an articulating pivoted counterweighted support linkage (not shown in the drawings). Supply conduit 25 flexes freely to accommodate this reciprocating torch movement.

Figure 5:
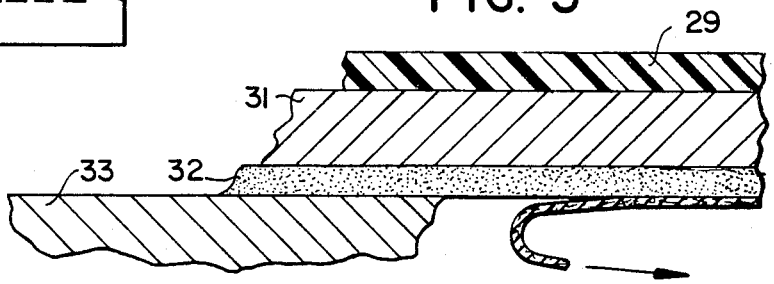
FIG. 5 is a greatly enlarged cross-sectional side elevation view of a portion of the substrate employed in the methods and apparatus of the present invention.

Aluminum foil with a laminated polytetrafluoroethylene "Teflon" surface layer has proved to be a highly effective iXpact substrate. In FIG. 5 a greatly enlarged cross-section of this preferred substrate is illustrated. The outermost layer of belt 14 is formed of a thin film 29 of Teflon FEP, approximately one mil thick. This Teflon layer 29 is laminated directly to a slightly thicker layer of aluminum foil 31, two mils thick, for example. The opposite face of foil layer 31 is bonded by a layer of adhesive cement 32 to a flexible temperature-resistant belt 33 of sheet metal or woven or non-woven fabric. The adhesive layer 32 and the belt 33 are both flexible and the Teflon coating 29 and the very thin layer of aluminum foil 31 are also flexible. If desired, the flexible impact film 29 of Teflon may be laminated directly to thicker flexible sheet aluminum backing performing the functions of foil 31 and metal backing 33 in FIG. 5, and eliminating the need for adhesive 32. This flexibility allows belt 14 to flex freely as it passes around the large diameter rollers 15 and 16. This assures that belt 14 will have an extended useful life despite the high temperatures employed in the atomization step of the process.

The reciprocating transverse movement of plasma torches 18 back and forth across the width of belt 14 produces a constantly shifting impact zone as the belt moves along its endless path between rollers 15 and 16. The combination of belt advance and reciprocating torch movement produces a zigzag pattern of impact zones on the belt and minimizes local heating by the plasma jets 22 impacting upon the surface of Teflon-coated belt substrate 14. Aluminum foil layer 31 aids in rapidly carrying away heat, further extending the useful life of belt 14.

Alternatively, the desired relative motion of substrate belt 14 and torch 18 can be produced by driving the belt rollers 15 and 16 in a combination of axial reciprocating and rotational movement so that all points on the peripheral surfaces of the rollers follow a sinusoidal path, producing sinusoidal movement of belt 14 relative to torch 18. The two components of this belt movement relative to torch 18 should of course be out of phase to assure that every pass of belt 14 through each plasma torch impact zone exposes a fresh area of the belt to the hot plasma stream.

Figure 4:
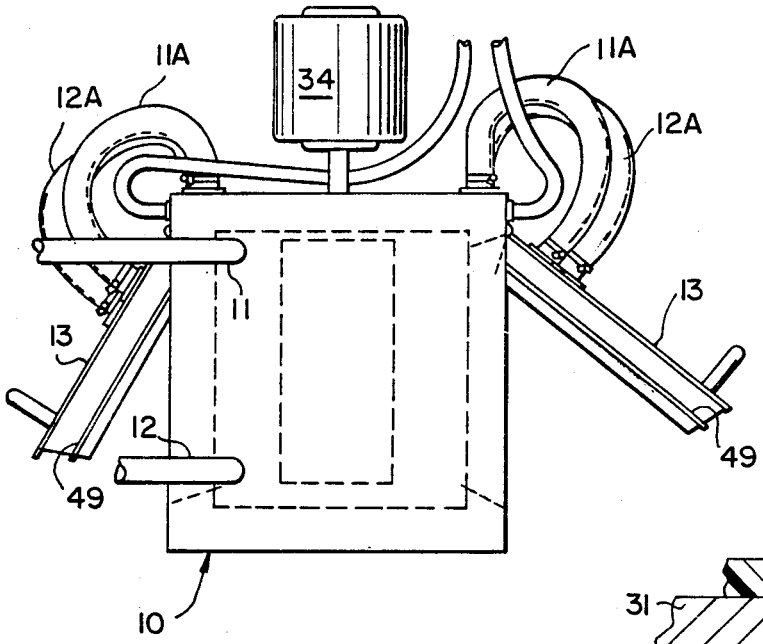
FIG. 4 is a top plan view of the water-jacketed housing surrounding the working chamber illustrated in FIG. 1.
Figure 4A:
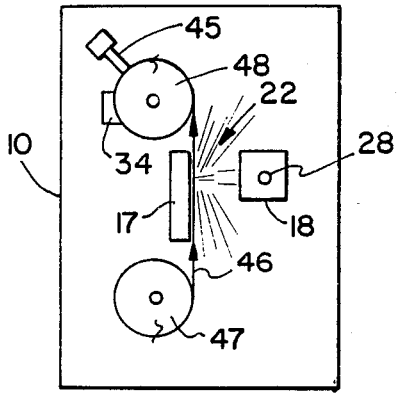
FIG. 4A is a schematic side elevation view of the apparatus employed in a third embodiment of the invention.

The impact substrate, as shown in FIG. 4A, can also be formed as a greatly elongated web 46 unwound from a supply reel 47 past torch 18 and between plasma jet 22 and support paten 17, to be rewound on a takeup reel 48. Liquid rinsing jet 45 and wiping squeegee 34 remove residual powder, and the elongated web 46 can be rewound on the supply reel like movie film and repeatedly reused in the same fashion, employing suitable drive motors on reels 47 and 48.

Residues of atomized powder are minimized on the Teflon surface of belt 14 because the smooth, low friction surface of the Teflon coating resists wetting of the substrate surface by the impacting molten drops of pulverized material. Atomized powder particles which might happen to adhere to the Teflon surface of the substrate belt 14 would tend to interfere with subsequent impact atomization, on the next pass of the belt beneath the plasma torch 18. Therefore, such residues are preferably removed from the belt by the squeegee wiping action of a liquid-wetted wiping sponge 34 beneath which the belt 14 passes in sliding engagement, being sandwiched between sponge 34 and support platen 17, as shown in FIG. 1.

As a result, any accumulated powder adhering to the Teflon surface 29 of belt 14 is wiped away by the sponge, and drained from the sponge by the impregnating liquid. This liquid is preferably water in the case of ceramic powder atomization, and oil or an organic liquid such as hexane in the case of metal powder atomization. Liquid squeezed from the sponge 34 by its compression against the passing belt 14 carries away any excess powder picked up from belt 14 and entrained in the excess liquid. Any moisture remaining on the surface of belt 14 is quickly evaporated by the high ambient temperatures inside housing 10 resulting from operation of the plasma torches 18.

Figure 2:
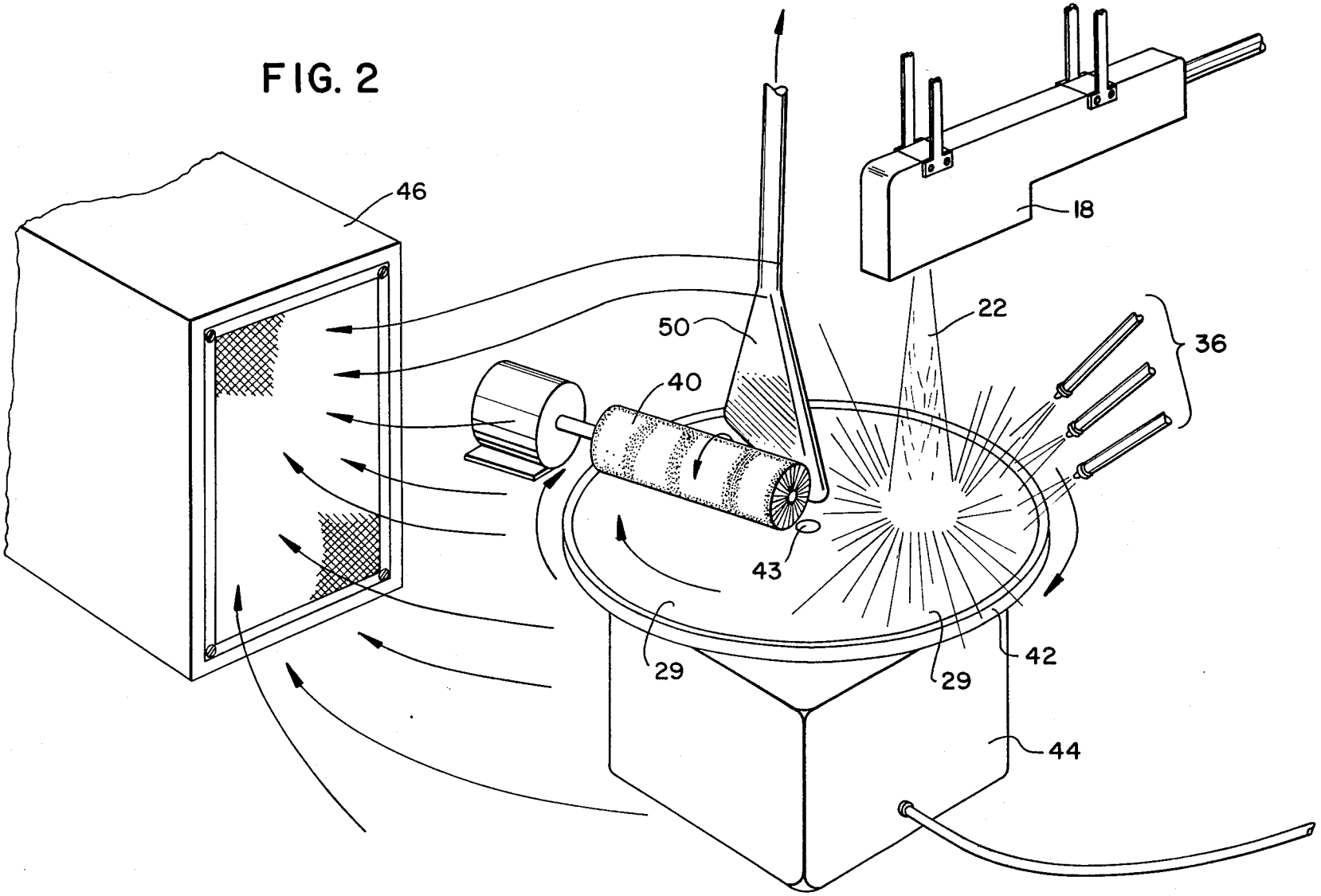
FIG. 2 is a schematic perspective view of the apparatus employed in a second embodiment of the present invention.

In place of or supplementing the liquid rinsing and squeegee wiping shown in FIG. 1, one or more jets of pressurized liquid such as jets 45 shown in FIG. 1, may be aimed at substrate 14. Alternatively as indicated in FIG. 2, a revolving cleaning brush 40 engaging the impact substrate 29, or a vacuum intake hood 50, or a vacuum cleaner type combination of brush 40 and vacuum hood 50 may be employed to remove accumulated atomized powder residues from the impact substrate.

A quench gas stream enters the interior of housing 10 at room temperature through one or more nozzles 36 aimed at the impact zone of each plasma jet. The quench gas temperature may be reduced by its expansion through nozzles 36.

While the exact mechanism of the atomization impact of the plasma jet 22 against the Teflon faced belt 14 is not certain, it is believed that each of the molten liquid drops carried by the plasma jet impacts to form a ring-shaped droplet corona, taking advantage of the smoothness of belt 14 and the non-wetting, low-friction Teflon surface, with the resulting tiny droplets rapidly chilling due to the action of the quench gas stream delivered by quench gas nozzle means 36 aligned with the plasma torch and aimed at the impact stream's impact zone Con belt 14. The quench gas may be the same gas supplied through gas inlet 21 to create the plasma jet and carry the molten droplets to the impact zone. Helium or hydrogen are preferred quench gases because of their high thermal conductivity, but argon and nitrogen are often used. This quick chilling, at a chill rate on the order of 100,000 or more degrees per second, produces such rapid solidification of the atomized droplets that they customarily exhibit homogeneous internal structure. These particles also exhibit very fine grain size, and may even be amorphous, i.e., without ordered atomic structure. Most of these atomized particles solidify with a spheroidal outer surface.

The resulting cloud of atomized fine powder particles filling the interior of housing 10 descends by gravity toward the bottom of the housing, passing with excess rinsing liquid through a hopper 37 to a powder collection sump 38. The powder sump 38 is preferably detachable and interchangeable so that it may be removed and replaced by a fresh empty sump 38 in order to facilitate the powder recovery operation.

As indicated in FIG. 1, the sump 38 is provided with a sight glass 39 indicating the level of accumulated liquid collected therein. The sump 38 is also provided with a detachable latch 41 securing it to the lower end of hopper 37 forming the bottom of housing 10. When the level of liquid indicated in sight glass 39 reaches the point when sump 38 should be emptied and the powder collected therein recovered, latch 41 can be opened and the detachable sump 38 disconnected from the lower end of hopper 37. A fresh, empty collection sump 38 is then moved into position and secured to hopper 37 by closing latch 41 and the accumulated contents of the filled sump 38 may be recovered by evaporating the liquid or centrifuging the powder slurry to separate the powder and liquid in the sump.

Wet filtration or vacuum drying or spray drying techniques may also be used to recover the atomized powder particles collected in the liquid of sump 38.

REVOLVING DISK SUBSTRATE

In the embodiment of the invention illustrated in FIG. 2, the impact substrate for atomization of molten powder drops carried in the plasma torch jet takes the form of a revolving metal or ceramic disk 42. The cross-section of the disk 42 is generally similar to FIG. 5, preferably with a thin layer 29 of Teflon FEP forming the exposed impact surface, with its underside bonded to a thicker layer of aluminum foil 31 secured by an adhesive 32 to a metal or ceramic turntable disk taking the place of the temperature resistant belt 33 illustrated in FIG. 5. The disk 42 is centrally supported on the end of a motor shaft 43 turned by motor 44 and thereby presenting a constantly changing zone of the substrate 29 in the impact path of plasma torch 18. Quench gas delivered by the quench gas nozzles 36 aimed at the impact zone is supplied at a much lower temperature than the similar gas forming part of the plasma torch jet, and the introduction of a gas under pressure through both torch 18 and nozzle 36 produces a current tending to cause atomized powder particles, suspended in the atmosphere inside the housing surrounding the assembly shown in FIG. 2, to flow through a vacuum intake powder collector 46 which may be provided with one or more fine mesh filter screens similar to dust collector bags, or may employ electrostatic precipitation techniques to attract the atomized powder particles to collection surfaces inside the powder collector 46. The revolving brush 40, or the vacuum intake hood 50, or both employed together, as shown in FIG. 2, are used to remove residual atomized powder from impact surface 29 before each pass through the plasma jet stream 22. As indicated in FIG. 1, a wiper sponge 34 may be positioned for squeegee wiping contact with substrate 29, and provided with a liquid jet supply 47 through rinsing liquid jets 45, or a liquid manifold 48 positioned adjacent to the squeegee wiper 34.

The rotating disk embodiment illustrated in FIG. 2 is customarily used with ceramic powder atomization processes, in which the rinsing liquid is normally water, and the operating temperatures maintained by plasma torch 18 quickly evaporate liquid employed soon after the squeegee wiping action has been completed, assuring that the liquid leaves the working chamber as a vapor mixed with the flowing gas stream carrying atomized powder particles into powder collector 46. Since the wiping water is rapidly vaporized, there is no need for a liquid collection sump in the disk embodiment of FIG. 2 corresponding to sump 38 shown in the embodiment of FIG. 1, and the rotating disk atomization process is performed as a substantially dry operation.

While a single plasma torch is shown in FIG. 2 and a pair of plasma torches as shown in FIG. 1, three, four or more plasma torches may be employed if desired in a wider or longer housing 10, thus permitting scaling up of the volume of atomized powder produced while maintaining substantially the same operating characteristics for the process. The squeegee sponges 34 are shown removed some distance away from the impact zone of the plasma torch jet on the substrate in FIG. 1. However, for the best results it is often desirable to move the squeegee sponge 34 to a position closely adjacent and just upstream of the plasma jet impact zone on the moving substrate, to minimize any random deposit of airborne powder on the substrate before the plasma jet impact. As shown in the top view of FIG. 4, the belt drive motor 34 is preferably positioned outside housing 10 to assure that the motor and its bearings are isolated from the dusty environment inside the housing 10, and a dust seal around the motor shaft rotating the drive roller 15 is employed in the wall of housing 10. Dust-proof gaskets 49 on doors 13 retain the atomized powder particles inside housing 10.

ATOMIZED CERAMICS

Figure 6A:
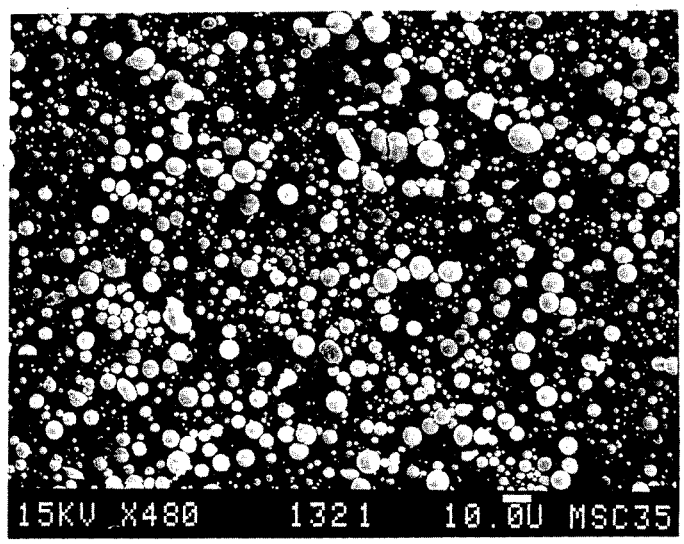
FIGS. 6A, 6B and 6C are three photomicrographs taken at successive magnifications of 480×, 1000× and 4000×, showing atomized zirconia particles produces by the techniques of this invention employing Teflon FEP film as an impact substrate.
Figure 6B:
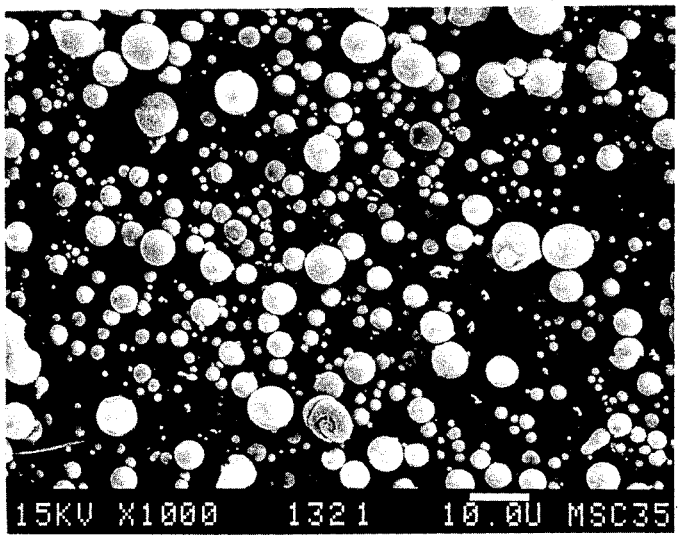
Figure 6C:
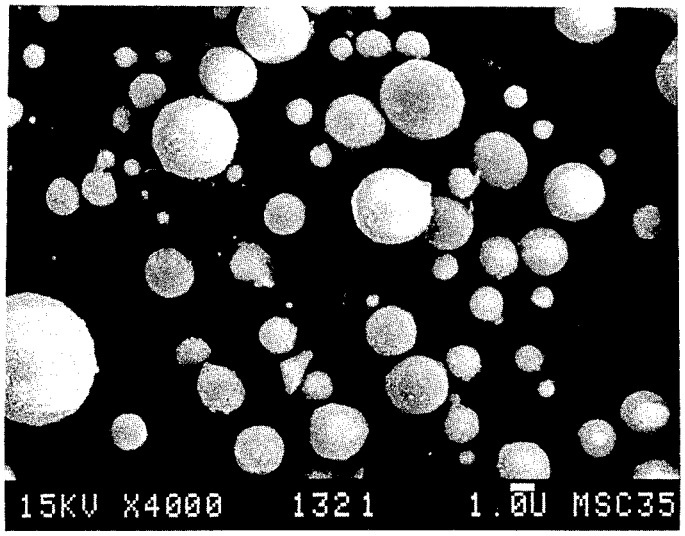

Atomization runs on calcia-stabilized zirconia, 200/325 mesh "PP-42" produced by Bay State Abrasives of Westboro, Mass. were employed to compare the effects of changes in gun-to-substrate distance, plasma stream impact angle, and recycling the atomized material in a double atomization operation. Viewed in the electron microscope, the starting powder appeared to be sharp irregular chips having dimensions ranging from 20 to 50 micrometers. As shown in FIGS. 6A, 6B and 6C, the resulting atomized powder particles are almost entirely spherical, with diameters ranging between 1 and 10 micrometers.

When Teflon FEP film was employed dry as the impact substrate, good results were achieved for several minutes, after which small patches of melted ceramic appeared on the substrate. This is believed to have been caused by fine powder electrostatically adhering to the substrate. On subsequent passes of the substrate through the plasma stream impact zone, such residual powder apparently melted and coalesced in situ.

Cleansing of the impact substrate before each pass through the impact zone to remove such residual powder particles can be achieved successfully by vacuum cleaning, or by a liquid rinse and squeegee wiping step. This removes any residual accumulations of electrostatically attracted powder, and facilitates continuous powder atomization over long production runs.

Table 1 shows the particle sizes observed after a series of seven powder production runs, Sample 14-1 was atomized using the dry Teflon FEP substrate described above. The remaining runs were all made on a Teflon FEP substrate which was liquid rinsed and squeegee wiped. For runs 15-3, 14-2 and 15-2, the axis of the plasma stream was substantially normal to the substrate surface, and the distance was reduced successively from 5 inches to 4 inches to 3 inches, producing successively finer average particle sizes as Table 1 shows.

In run 14-3, the plasma stream axis was inclined at 45 degrees to the surface of the impact substrate, producing a wider range of particle sizes and a slight increase in average particle diameter.

The accompanying photomicrographs of FIGS. 6A, 6B and 6C show the shape and size distribution of zirconia powder atomized by plasma torch jet impact against a dry Teflon FEP film substrate utilizing the equipment illustrated in the embodiment of FIG. 2. Virtually all these atomized powder particles are spherical and their size ranges are shown in the particle size distribution figures summarized in Table 1.

TABLE 1

PARTICLE SIZE DISTRIBUTION PARAMETERS FOR ATOMIZED ZIRCONIA

| | | | % Less than Indicated Diameter | | | | | |
|---|---|---|---|---|---|---|---|---|
| Sample No. | Variable | Mean(um) | 40 um | 20 um | 10 um | 3 um | 1 um | 0.5 um |
| 14.1 | DRY TEFLON FEP | 5.2 | 100 | 100 | 95 | 20 | 9 | 7 |
| 15.3 | 5"G/S Dist. | 4.9 | 96 | 91 | 77 | 36 | 21 | 16 |
| 14-2 | 4"G/S Dist. | 5.2 | 100 | 97 | 80 | 34 | 23 | 20 |
| 15-2 | 3"G/S Dist. | 1.4 | 99 | 97 | 91 | 62 | 48 | 41 |
| 14-3 | G/S Angle 45 degrees | 3.0 | 100 | 95 | 80 | 50 | 40 | 32 |

Particle sizes for the atomized zirconia powder particles are shown in the particle size distribution diagrams annexed as the diagrams of FIGS. 7-11. As clearly illustrated in these size distribution curves, 50% of the atomized powder particles are customarily smaller than five micrometers in diameter and may be smaller than one, two or three micrometers in diameter. The great majority of atomized powder particles are less than ten micrometers in diameter.

Table 2 summarizes the excellent density figures for these powders after consolidation by hot pressing, i.e., the application of heat and pressure to the powders. This confirms that these powders are ideal for hot pressing purposes. It is conjectured that these good hot pressing results are promoted by the very fine and stable particle size, sphericity, and extremely favorable powder densities.

TABLE 2

HOT PRESSING DATA FOR PLASMA MELTED AND IMPACT ATOMIZED POWDERS

| Time, Min | Temperature, °C. | Density (Theo. = 5.32 g/cm³) g/cm³ | % Theoretical |
|---|---|---|---|
| Zirconia/Calcia (Theo. Density = 5.32 g/cm³) | | | |
| 70 | 1192 | 4.75 | 89.3 |
| 75 | 1257 | 4.88 | 91.7 |
| 80 | 1298 | 4.97 | 93.4 |
| 85 | 1363 | 5.10 | 95.9 |
| 90 | 1406 | 5.20 | 97.7 |
| 95 | 1465 | 5.34 | 100.4 |
| Alumina/Zirconia/Yttria (Theo. Density = 4.70 g/cm³) | | | |
| 80 | 1273 | 4.06 | 86.4 |
| 85 | 1330 | 4.16 | 88.5 |
| 90 | 1377 | 4.31 | 91.7 |
| 95 | 1410 | 4.41 | 93.8 |
| 100 | 1440 | 4.50 | 95.7 |
| 105 | 1471 | 4.60 | 97.9 |
| 110 | 1500 | 4.67 | 99.4 |

These dense powders permit powder uniformity and high packing densities in the molding cavity, reducing the extent of compaction needed to produce the final part. This is believed to be explained by the better flow and packing properties exhibited by these atomized powders as compared with other powders of comparable agglomerate or particle sizes, presumably because the great majority of the powder particles are dense and spherical. These characteristics evidently facilitate powder flow and packing to improve die and mold filling, producing the resulting extremely high densities and absence of flaws or voids observed with hot pressed components formed from these atomized powders. Presumably the smooth, spherical powder particles produced by the processes of this invention allow more particle movement during the early pressure application stages of the hot pressing process.

ATOMIZED METALS

Excellent results have also been achieved with the processes and apparatus of the invention in producing very fine metal powders.

Agglomerated molybdenum powder, −200+325 mesh was delivered at the rate of 10 lbs. per hour to the plasma gun shown in FIG. 1, spaced 4 inches from the rotating disk Teflon FEP substrate with the plasma stream axis normal to the disk surface. Average current of 600 amp. was drawn at voltages ranging between 25 and 30 volts. The resulting atomized powder comprised almost entirely spherical particles having diameters under 10 micrometers.

316 L stainless steel powder, −200+325 mesh was treated similarly, with the gun spaced 3 inches from the rotating disk Teflon FEP substrate. 500 amp. average current was drawn at 20–25 volts, producing atomized stainless steel powder of the same character and particle size range, almost entirely spherical particles under 10 micrometers in diameter.

Water was employed as the substrate rinsing liquid with both the agglomerated molybdenum powder and the 316 L stainless steel powder. In addition, the stainless steel powder was also delivered through the plasma gun to a slightly different impact substrate, 0.001" "Teflon PFA" polytetrafluoraethylene film supported on 0.002" aluminum foil cemented to the rotating disk. This Teflon PFA substrate was selected for temperature stability rated even higher than that of "Teflon FEP." Equivalent atomized stainless steel powder was produced using each substrate.

Furthermore, the replacement of water by hexane as the substrate rinsing liquid, produced the same atomized stainless steel powder, indicating that volatile hydrocarbon solvents may be used in place of water in the processes of this invention.

The orientation of the rotating disk of FIG. 2 in either a vertical or a horizontal plane was also found to have no effect on the atomized powder produced.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. Apparatus for atomizing of ceramics or metals comprising

A. a heat-resistant housing enclosing an impact chamber and having gasketed access door means formed therein, B. cooling means installed in the housing and door means, C. substrate-advancing means juxtaposed to an impact zone in the chamber and supported by the housing, D. an impact substrate comprising a thin film of polytetrafluoroethylene polymer mounted on the advancing means for advancing edge-wise movement through the impact zone, E. chilling gas nozzle means supported by the housing and aimed to deliver pressurized chilling gas through a quench gas chill zone adjacent to the impact zone, F. a plasma torch supported in the chamber, connected to a source of electrical power and to a pressurized supply source of gas entraining pulverized feed material to be atomized, aimed to deliver the hot plasma jet carrying molten drops of feed material to impact on the advancing substrate in the impact zone, producing rebounding atomized droplets chilled and solidified to produce microatomized particles in the quench gas chill zone by the chilling gas, G. substrate-cleaning means supported in the chamber juxtaposed to the advancing substrate near the impact zone, H. powder recovery means connected to receive and collect powder produced in the impact zone.

2. The apparatus defined in claim 1, wherein the impact substrate is "Teflon FEP."

3. The apparatus defined in claim 2, wherein the impact substrate is "Teflon PFA."

4. The apparatus defined in claim 1, wherein the thin polymer film is backed by a thicker layer of metallic foil.

5. The apparatus defined in claim 4, wherein the foil is aluminum foil.

6. The apparatus defined in claim 1, wherein the polymer film is mounted on an elongated flexible substrate web mounted for end-wise advancing movement impelled by the substrate advancing means.

7. The apparatus defined in claim 6, wherein the elongated flexible substrate web is formed as an endless belt drivingly supported by at least one driven belt-roller comprising the substrate advancing means.

8. The apparatus defined in claim 1, wherein the thin polymer substrate film is mounted on the face of a disk rotatably mounted in the impact zone comprising the substrate advancing means.

9. The apparatus defined in claim 1, wherein the substrate advancing means is driven by an electric motor mounted outside the housing and having its shaft extending through the housing into the impact chamber and connected to drive the substrate advancing means.

10. The apparatus defined in claim 1, wherein the plasma torch and the substrate-advancing means are connected for relative traversing movement, translating the impact zone across the impact substrate in a sinuous path.

11. The apparatus defined in claim 10, wherein the plasma torch is mounted for reciprocating movement in a direction transverse to the advancing movement of the impact substrate.

12. The apparatus defined in claim 10, wherein the plasma torch is provided with a powder and gas feed conduit, a cooling water inlet conduit, a cooling water outlet conduit, and electrical power conductors, and further including a flexible supply conduit enclosing said inlet, outlet and feed conduits and power conductors and connecting them through a wall portion of the housing to the reciprocating plasma torch.

13. The apparatus defined in claim 1, wherein the substrate cleaning means includes a liquid rinsing jet means.

14. The apparatus defined in claim 1, wherein the substrate cleaning means includes liquid-moistened wiping squeegee means.

15. The apparatus defined in claim 1, wherein the substrate cleaning means includes a vacuum hood positioned close to the impact substrate.

16. The apparatus defined in claim 1, wherein the substrate cleaning means includes a brush mounted for relative movement in brushing contact with the impact substrate.

17. The apparatus defined in claim 1, wherein the powder recovery means includes a collection sump detachably connected to the housing near a lower end thereof.

18. The apparatus defined in claim 17, wherein the collection sump incorporates an external sight glass through which the level of liquid accumulated in the sump can be observed.

19. The apparatus defined in claim 1, wherein the powder recovery means includes a vacuum intake filter screen assembly.

20. A method for atomizing granulated metal and ceramic feed material into fine particle size powder, comprising the steps of conveying an impact substrate comprising a thin film of polytetrafluoroethylene polymer edge-wise along a continuous path through an impact zone in an enclosed chamber, cleaning the exposed surface of the impact substrate, delivering granulated feed material entrained in a stream of gas through a plasma torch having its hot plasma jet directed toward the substrate in the impact zone, producing molten drops of feed material impacted and rebounding into molten droplets, delivering a stream of chilling gas through a quench gas chill zone adjacent to the impact zone, rapidly solidifying the molten droplets into fine particle size powder, and recovering the fine particle size powder from the enclosed chamber.

21. The method defined in claim 20, wherein the path along which the impact substrate is conveyed through the impact zone is an endless path along which the substrate is continuously recycled.

22. The method defined in claim 20, wherein the chilling gas and the hot plasma jet are simultaneously and continuously delivered to the impact zone.

23. The method defined in claim 20, wherein the substrate cleaning is performed by delivering pressurized rinsing liquid to wash the impact substrate.

24. The method defined in claim 20, wherein the substrate cleaning is performed by wiping the impact substrate approaching the impact zone with a liquid-moistened squeegee wiping operation.

25. The method defined in claim 20, wherein the hot plasma jet is moved to traverse it in reciprocating motion across the impact zone in a direction transverse to the edge-wise movement of the impact substrate.

26. The method defined in claim 20, wherein the powder recovering operation is performed in a vacuum-exhausting flow path along which the atmosphere from inside the enclosed chamber is drawn through a fine mesh filter screen entrapping the fine particle size powder.

* * * * *